US007226241B2

(12) United States Patent
DiTullio

(10) Patent No.: US 7,226,241 B2
(45) Date of Patent: Jun. 5, 2007

(54) STORM WATER CHAMBER FOR GANGING TOGETHER MULTIPLE CHAMBERS

(75) Inventor: Robert J. DiTullio, Warren, CT (US)

(73) Assignee: Cultec, Inc., Brookfield, CT (US)

( * ) Notice: Subject to any disclaimer, the term of this patent is extended or adjusted under 35 U.S.C. 154(b) by 0 days.

(21) Appl. No.: 10/392,581

(22) Filed: Mar. 20, 2003

(65) Prior Publication Data

US 2004/0184884 A1 Sep. 23, 2004

(51) Int. Cl.
*E02B 11/00* (2006.01)

(52) U.S. Cl. ..... 405/46; 405/49

(58) Field of Classification Search ..... 405/43, 405/45, 46, 48, 49; 210/170, 170.03, 170.1
See application file for complete search history.

(56) References Cited

U.S. PATENT DOCUMENTS 2,153,789 A * 4/1939 Carswell et al. ..... 405/48
2,767,801 A * 10/1956 Eads ..... 210/170
3,897,090 A * 7/1975 Maroschak ..... 405/49
3,926,222 A * 12/1975 Shroy et al. ..... 405/49
5,087,151 A 2/1992 DiTullio
5,156,488 A 10/1992 Nichols
5,419,838 A 5/1995 DiTullio
5,773,756 A 6/1998 DiTullio
5,890,838 A * 4/1999 Moore et al. ..... 405/49
6,129,482 A * 10/2000 Ditullio ..... 405/43
6,322,288 B1 11/2001 DiTullio
6,361,248 B1 * 3/2002 Maestro ..... 405/49
6,612,777 B2 * 9/2003 Maestro ..... 405/49
2002/0025226 A1 * 2/2002 Maestro ..... 405/43

OTHER PUBLICATIONS

St. Marseille, J.G.; Anderson, B.C., Use of Leaching Chambers for On-Site Sewage Treatment; 2002; Environmental Technology, vol. 23, pp. 261-272.
Cultec, Inc.; Cultec Patented Interlocking Rib Connection (printout from www.cultec.com web pages); Oct. 2001.
Cultec, Inc.; Plastic Septic and Stormwater Chambers (printout from www.cultec.com web pages); Sep. 2002.

* cited by examiner

*Primary Examiner*—Michael Safavi
(74) *Attorney, Agent, or Firm*—St. Onge Steward Johnston & Reens LLC

(57) ABSTRACT

A liquid dispensing chamber for use with a drainage system for gathering and dispensing liquids to the ground is disclosed, which includes an elongated wall body having a generally arch-shaped cross-sectional configuration with a top wall portion and a pair of side wall portions thereby defining an enlarged enclosure therein, the elongated wall body including a first end portion and a second end portion, at least one of the end portions defining therein an axial opening to allow axial flow of liquids there-through, a plurality of circumferential reinforcing members disposed along the circumference of the elongated wall body for reinforcing structural strength thereof, and at least one side desk member disposed at least a location in the side wall portions of the elongated wall body. The at least one side deck member selectively includes a lateral opening therein for connecting a connection conduct thereto. Liquid drainage systems utilizing the liquid dispensing chambers of the invention is also disclosed.

14 Claims, 9 Drawing Sheets

STORM WATER CHAMBER FOR GANGING TOGETHER MULTIPLE CHAMBERS

FIELD OF THE INVENTION

The present invention relates to a system for dispensing liquids and, more particularly, to liquid dispensing chambers and a liquid drainage system using the liquid dispensing chambers for gathering and dispensing liquids to the ground.

BACKGROUND OF THE INVENTION

Various methods, systems and apparatus are known to handle wastewater and/or storm water. Culverts, catch basins, storm sewers and out falls have been used for handling storm water. Although such systems provide substantial advantages over direct discharge into the existing water body, they preclude other uses of the land. This is particularly important where land values are high such as in urban, residential and industrial areas. In addition, such known approaches have adverse environmental effects, for example, lowering of local water tables when water is diverted from percolating into the earth.

Consequently, it is desirable to direct rain or storm water into the earth. This has typically been done such as by using infiltration trenches filled with large gravel or crushed stone with perforated pipes running there though. Stone filled trench systems are somewhat non-economical or inefficient since the stone occupies a substantial volume limiting the ability of the system to handle large surge volumes associated with heavy storms. Both the stone and the perforated pipe are also susceptible to clogging by particles or debris carried by water.

Recently, in order to solve such problems or disadvantages, underground plastic drainage chambers have been introduced in the market for handling either storm water or sewage system effluent. Such plastic chambers typically have an arch-shaped cross-section and are relatively long with open bottom for dispersing water beneath the surface of the ground. Plastic storm water chambers are generally laid on gravel side by side in parallel rows. End portions of the chambers are connected to a catch basin, typically through a plastic or metal pipe network to distribute storm water to drainage chambers in high velocity.

SUMMARY OF THE INVENTION

The present invention is directed to provide a novel liquid dispensing chamber, together with a liquid drainage system incorporating the liquid dispensing chambers of the invention. The liquid dispensing chamber of the invention provides a storage volume bigger than conventional pipes having the same height, and it is to be installed with its open bottom directly set on a crushed stone base. Thus, a system using the liquid dispensing chamber of the invention distributes the storm water in a velocity substantially lower than the conventional pipe systems. By utilizing the lower velocity, water can be properly treated in the process. Screens or filter baffles may be installed to remove trash and sediment. The ultimate drainage system using the dispensing chambers of the invention can be easily constructed on site by the simple "lay-up" connection method that will be described further in detail.

In accordance with one preferred embodiment of the invention, a liquid dispensing chamber for use with a drainage system for gathering and dispensing liquids to the ground is provided, which includes: an elongated wall body having a generally arch-shaped cross-sectional configuration with a top wall portion and a pair of side wall portions thereby defining an enlarged enclosure therein, the elongated wall body including a first end portion and a second end portion, at least one of the end portions defining therein an axial opening to allow axial flow of liquids there-through; a plurality of circumferential reinforcing members disposed along the circumference of the elongated wall body for reinforcing structural strength thereof; and, at least one side deck member disposed at least a location in the side wall portions of the elongated wall body.

In accordance with another preferred embodiment of the inventor, a liquid dispensing chamber for use with a drainage system for gathering and dispensing liquids to the ground is provided, which includes: an elongated wall body having a top wall portion and a pair of side wall portions thereby defining an enlarged enclosure therein, the elongated wall body including a first end portion and a second end portion, at least one of the end portions defining therein an axial opening to allow axial flow of liquids there-through; a plurality of circumferential reinforcing members of rib-like configuration formed on the elongated wall body for reinforcing structural strength thereof; and, at least one side deck member disposed at a bottom area of the side wall portions of the elongated wall body, the respective one side deck member including a face raised laterally from the lower surface of the side wall portions.

In accordance with another preferred embodiment of the invention, a liquid dispensing chamber for use with a drainage system for gathering and dispensing liquids to the ground is provided, which includes: an elongated wall body having a top wall portion and a pair of side wall portions thereby defining an enlarged enclosure therein, the elongated wall body including a first end portion and a second end portion, at least one of the end portions defining therein an axial opening to allow axial flow of liquids there-through; a plurality of circumferential reinforcing members of rib-like configuration formed on the elongated wall body for reinforcing structural strength thereof; and, at least one side deck member disposed at a bottom area of the side wall portions of the elongated wall body, the respective one side deck member including an opening therein to allow the user to connect a dispensing chamber or a connection conduit thereto.

In accordance with a further preferred embodiment of the invention, a liquid drainage system for gathering and dispensing liquids to the ground is provided, which includes: (1) a liquid dispensing chamber including: an elongated wall body having a top wall portion and a pair of side wall portions thereby defining an enlarged enclosure therein, the elongated wall body including a first end portion and a second end portion, at least one of the end portions defining therein an axial opening to allow axial flow of liquids there-through; a plurality of circumferential reinforcing members of rib-like configuration formed on the elongated wall body for reinforcing structural strength thereof; and, at least one side deck member disposed at a bottom area of the side wall portions of the elongated wall body, the respective one side deck member including an opening therein; and, (2) a connection chamber having a first end and a second end, the first end of the connection chamber connected to the opening of the respective one side deck member of said liquid dispensing chamber.

BRIEF DESCRIPTION OF THE DRAWINGS

Preferred embodiments of the invention are described herein with reference to the drawings, wherein.

DETAILED DESCRIPTION OF THE DRAWINGS

Preferred embodiments of the present invention are described herein with particular references to the drawings. The present invention disclosure consists basically of two parts, i.e., the first part is regarding liquid dispensing chambers which is described in association with FIGS. 1–8, and the other part is regarding related liquid drainage systems utilizing the dispensing chambers of the invention which is described in association with FIGS. 9–12. The invention is particularly useful for and thus described primarily in association with storm-water handling and/or dispensing system. However, it is to be noted that the invention may be applicable to any kinds of wastewater handling systems such as commercial or domestic septic systems.

Figure 1:
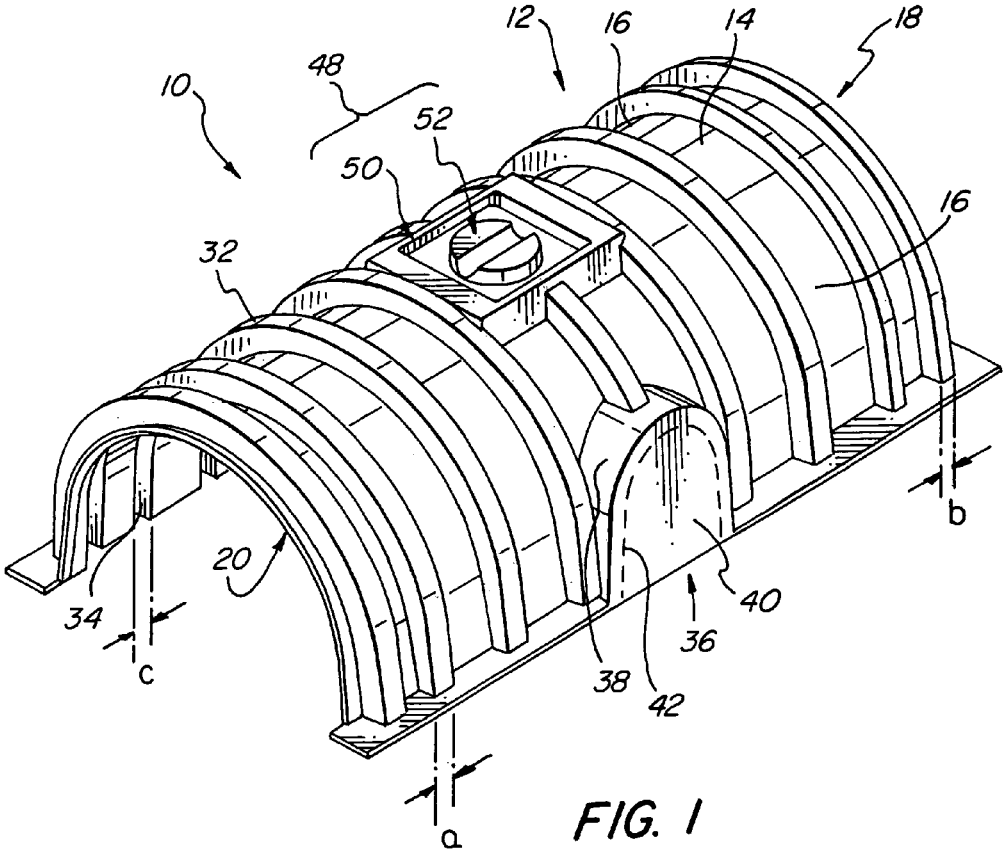
FIG. 1 is a perspective view of the liquid dispensing chamber constructed in accordance with the principles of the present invention.
Figure 2:
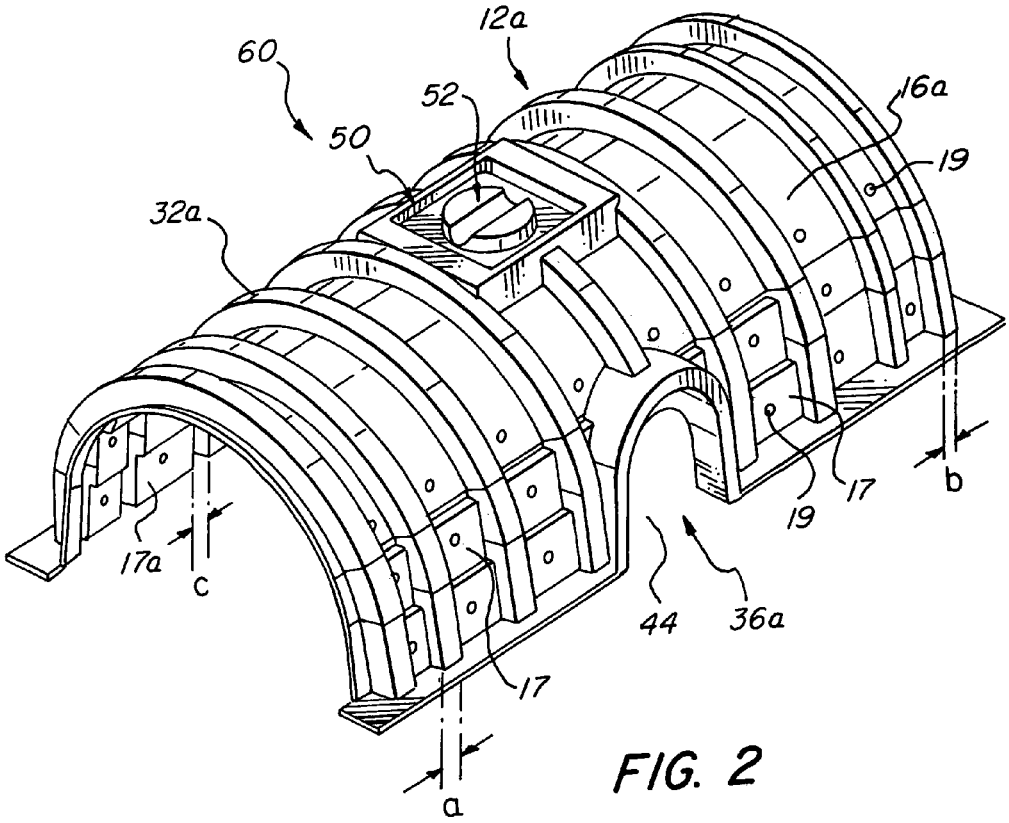
FIG. 2 is a perspective view illustrating another embodiment the liquid dispensing chamber of the present invention.
Figure 4:
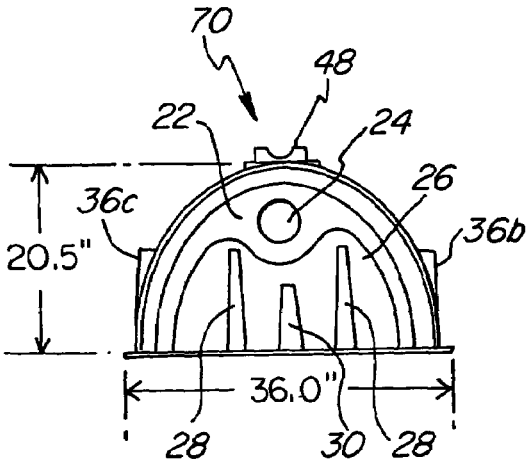
FIG. 4 is a front view of the liquid dispensing chamber shown in FIG. 3.
Figure 5:
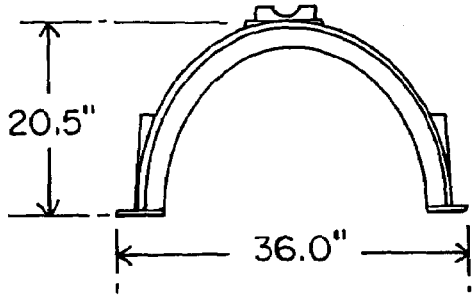
FIG. 5 is a rear view of the liquid dispensing chamber shown in FIG. 3.

FIG. 1 illustrates a preferred embodiment of the liquid dispensing chamber of the present invention. Liquid dispensing chamber 10 has a generally arch-shaped configuration and is preferably made of plastic material. Although an arch-like configuration is preferable, it may have other shapes such as a general rectangular or triangular configuration. Liquid dispensing chamber 10 includes elongated wall body 12 which is relatively thin and having top wall portion 14 and a pair of side wall portions 16. Side wall portions 16 may generally have a plain outer surface as shown in FIG. 1 or, alternatively, it may include a plurality of vertical wall panels 17 preferably at a lower area thereof with a plurality of infiltration apertures 19 formed therearound, as shown in FIG. 2. Elongated wall body 12 includes a first end portion 18 and a second end portion 20. As shown in FIG. 5, second end portion 20 is preferably open without end faces for blocking liquid flows there-through. However, depending upon particular types of the chamber, second end portion 20 may be partially open with a barrier (not shown) blocking at least a lower portion of the end portion, or completely closed without any openings therein. As shown in FIG. 4, first end portion 18 preferably includes end face 22 substantially closing the end portion except axial opening 24, which is provided at an upper location of the first end portion 18 to allow liquid inflows (or outflows) therethrough, for example, from a source such as a water catch basin. This type is referred to hereafter as an end-use type ("E-type") chamber suitable for use at either end location of the chamber assembly which is constructed by a plurality of chambers of the invention to expand the storage capacity for receiving and handling liquids therein. See, for example, FIGS. 9–10 in which reference numeral 100 denotes a chamber assembly with "E-type" chamber (reference numeral 10*e*) assembled therein. End face 22 may be substantially flat and vertical, or it can include raised area 26. It may also include vertically raised struts 28, 30 of suitable configuration, for reinforcing structural strength of the chamber to increase its load carrying capacity. However, depending upon particular usage, first end portion 18 may be at least partially open without including a substantial end face such as end wall 22. This type is referred to hereafter as an intermediate-use type ("I-type") chamber which is suitable for use at inter-connecting locations of a chamber assembly. See, for example, FIGS. 9–10 in which reference numeral 100 denotes a chamber assembly with "I-type" chamber (reference numeral 10*i*) assembled therein, also with "E-type" chamber (10*e*) as discussed above.

Liquid dispensing chamber 10 further includes a plurality of circumferential reinforcing members 32 disposed along the circumference of elongated wall body 12 for reinforcing the structural strength of the wall body 12. Circumferential reinforcing members 32 are preferably in the form of rib-like members attached thereto or formed integrally therewith the elongated wall body 12. The cross-sectional configuration of the circumferential reinforcing members may be varied, such as having a rectangular, hemi-circular, arched or sinusoidal outline. As shown in FIGS. 1–2, it is preferable that circumferential reinforcing members 32 are properly spaced and coaxially aligned along the periphery of the wall body 12. However, other disposition may be conceivable as long as they can support the wall body to increase the load bearing capacity. The load bearing capacity provided by the reinforcing members has a substantial significance since the chambers of the invention is particularly for using while buried underground and the ground area may be available for usages requiring a substantial loading capacity, such as using as a parking lot. It is also contemplated that circumferential reinforcing members 32 of the liquid dispensing chamber may be unitarily formed with the wall body 12, preferably by plastic molding, in which the combined structure defines a corrugated configuration with alternating peak portions and valley portions therein. As shown in FIGS. 1–2, the plurality of circumferential reinforcing members 32 preferably includes two sizes, i.e., some with an ordinary thickness "a" and others, preferably the last two at an end location, with a narrower thickness "b". Also, the circumferential reinforcing members 32 with "a" thickness define thereby, in association with wall body 12, a plurality of inner grooves 34 having a width "c" along the inner surface of the wall body 12. Here, "c" is configured to have a slight larger dimension than "b" such that another chamber may be connected in an end-to-end relationship with one another with one or two of the circumferential reinforcing members 32 with "b" thickness snugly fitting into the corresponding grooves 34 having "c" width. This connection may be performed by simply laying a second end portion 20 of a second chamber 10 up on a first end portion 18 of a first chamber 10 and thereby applying a suitable pressure thereon. This lay-up connection is advantageous in that it provides an easy on-site connection saving substantial labor costs, and it supplies an enhanced load bearing capacity to the combined chamber assemblies by doubling the reinforcing structures at the connection area.

Liquid dispensing chamber 10 further includes at least one side deck members 36 disposed at least a location in the side wall portions 16 of elongated wall body 12. In the preferred embodiment shown in FIG. 1, liquid dispensing chamber 10 includes a pair of side deck members 36 located at both center locations of the side wall portions 16. Side deck members 36 preferably include a raised wall portion 38 extending laterally from the side wall portion 16 and a generally arch-shaped front face 40. Raised wall portion 38 is also preferably arch-shaped and adjoins three circumferential reinforcing members with one circumferential reinforcing member connected to the top center portion of the raised wall portion 38 as shown in FIG. 1 for maintaining the vertical load bearing capacity of the chamber. Front faces 40 are generally vertical and preferably include a contour marking 42 therein of general arch-shaped configuration. This contour marking is for severing, if desired, by the user during the installation of the liquid dispensing chamber 10 to construct a resultant drainage system, thereby making a conduit or lateral opening 44 (FIG. 2) for connection of a suitable connection chamber thereto (see FIG. 8) or other conduits or pipes. Connection of such chambers will be described later in details.

Liquid dispensing chamber 10 preferably includes a pair of base flanges 46 extending laterally from side wall portions 16 and circumferential reinforcing members 32 for providing further stability and strength to the chamber 10. Base flanges 46 may be flush with the side deck members 36 or further extended laterally from the side deck members 36. Liquid dispensing chamber 10 may also include an access or inspection port 48 on top wall portion 14 thereof. Access port 48 preferably includes frame 50 and cover 52 detachably connected to the frame 50 permitting access and inspection of the interior of the chamber by the user.

Referring now to FIG. 2, another preferred embodiment of the liquid dispensing chamber of the present invention is described herein. Liquid dispensing chamber 60 is substantially similar to the liquid dispensing chamber 10 described herein-above except a few features that are discussed herein in further details. Liquid dispensing chamber 60 includes elongated wall body 12*a*, a plurality of circumferential reinforcing members 32*a*, at least one side deck member 36*a* and a plurality of base flanges 46*a*. Circumferential reinforcing members 32*a* are same or similar to the circumferential reinforcing members 32 as described above. Side deck members 36*a*, however, include a lateral opening 44 preformed therein to allow connection by other members, such as a connection chamber or other suitable conduits as described above, which allows in turn lateral flow of liquids there-through. Liquid dispensing chamber 60 includes side wall portions 16*a* having a plurality of vertical wall panels 17 disposed preferably at the lower area thereof with a plurality of infiltration apertures 19 formed there-around for facilitating dispensing of effluent to the surrounding area. Inner surface of the side wall portions 16*a* may also have a plurality of corresponding panel-like configurations 17*a*. Other features not specifically described herein with FIG. 2 are same or similar to those described above with respect to FIG. 1.

Figure 3:
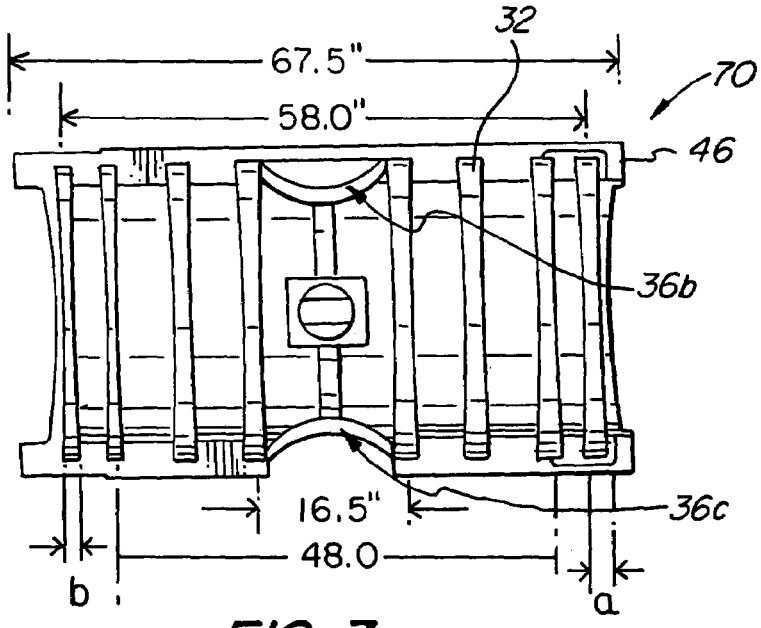
FIG. 3 is a top view illustrating another embodiment of the liquid dispensing chamber of the invention.

Referring to FIGS. 3–5, a preferred embodiment of the liquid dispensing chamber of the invention is described herein with particular exemplary dimensions depicting the size of one example. Other configurations and dimensions can be contemplated by one skilled in the art. Liquid dispensing chamber 70 is substantially similar to the liquid dispensing chamber 10 or 60 described herein-above except that the dispensing chamber 70 includes a closed or blind side deck member 36*b* in a first side wall portion 16 and an opened side deck members 36*c* in a second side wall portion 16' having a preformed lateral opening therein to allow connection of other chambers or conduits thereto. This type is referred to hereafter as a "right-tee type" chamber. Other features not specifically described here-with are same or similar to those described above with respect to FIG. 1.

Figure 6:
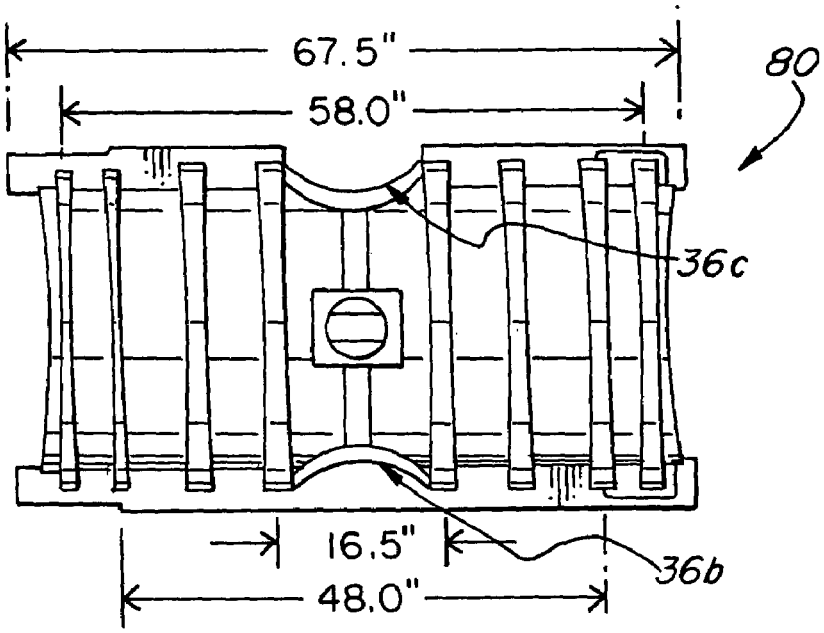
FIG. 6 is a top view illustrating a further embodiment of the liquid dispensing chamber of the invention.

Referring to FIG. 6, another preferred embodiment of the liquid dispensing chamber of the invention is described herein with particular exemplary dimensions depicting the size of one example. Other configurations and dimensions can be contemplated by one skilled in the art. Liquid dispensing chamber 80 is substantially similar to the liquid dispensing chamber 10 or 70 described herein-above except that the dispensing chamber 80 has the side deck member arrangement opposite to that of the chamber 70, i.e., including a closed or blind side deck member 36*b* in a second side wall portion 16' and an opened side deck members 36*c* (having a preformed lateral opening therein) in a first side wall portion 16. This type is referred to hereafter as a "left-tee type" chamber. Other features not specifically described here-with are same or similar to those described above with respect to FIGS. 1 and 5.

Figure 7:
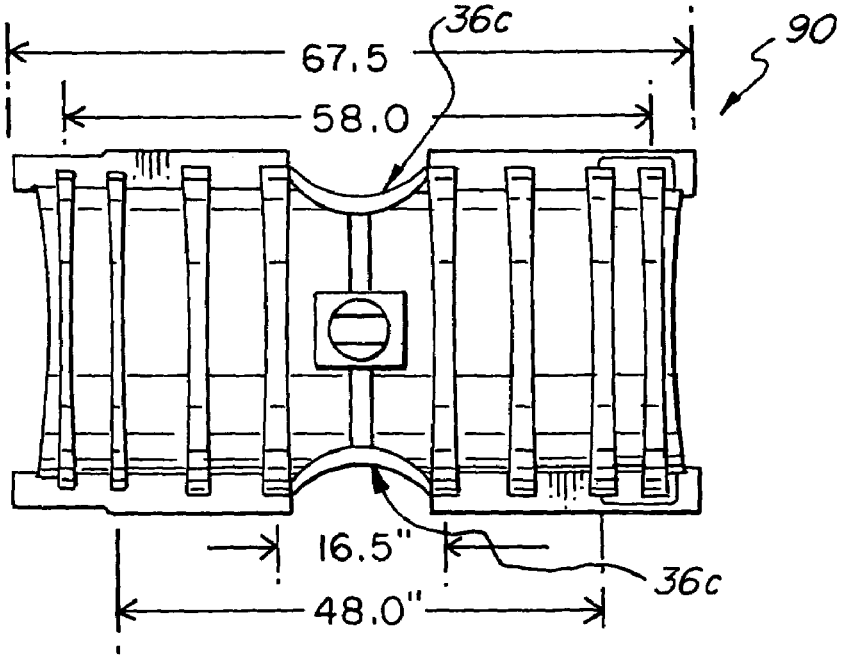
FIG. 7 is a top view illustrating a further embodiment of the liquid dispensing chamber of the invention.

Referring to FIG. 7, a further preferred embodiment of the liquid dispensing chamber of the invention is described herein with particular exemplary dimensions depicting the size of one example. Other configurations and dimensions can be contemplated by one skilled in the art. Liquid dispensing chamber 90 is substantially similar to the liquid dispensing chamber 70 or 80 described herein-above except that the dispensing chamber 90 includes two opened side deck members 36*c* (having a respective preformed lateral opening therein), one in a first side wall portion 16 and the other in a second side wall portion 16'. This type is referred to hereafter as a "double-tee type" chamber. Other features not specifically described here-with are same or similar to those described above with respect to FIGS. 1, 5 and 6.

Figure 8:
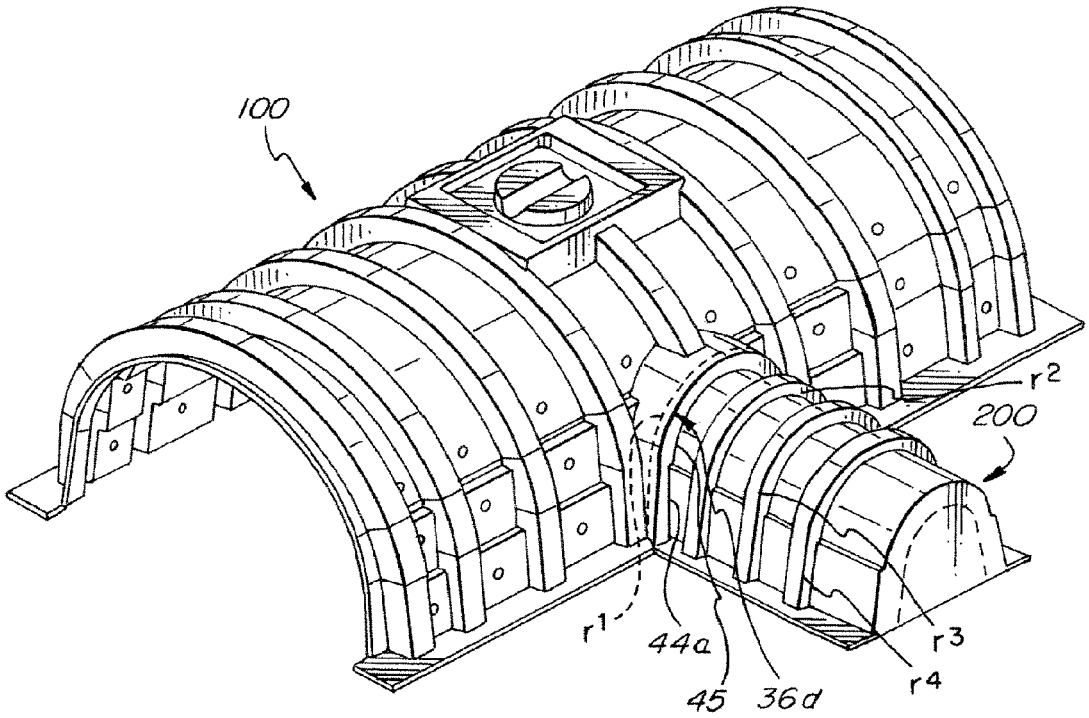
FIG. 8 is a perspective view illustrating the liquid dispensing chamber of the invention connected with a connection chamber.

FIG. 8 illustrates a preferable manner of connection of the chamber (for example, the chamber 10, 60, 70, 80 or 90) of the present invention, which is connected to a connection member through the side deck member. Liquid dispensing chamber 100 is substantially similar to the liquid dispensing chamber 10, 60, 70, 80 or 90 described herein-above. Liquid dispensing chamber 100 includes a side deck member 36*d* having a lateral opening 44*a* configured and dimensioned to receive a connection member 200 therein by the lay-up connection method similar to that described above with respect to the connection of the chambers. In the preferred embodiment, the particular connection member 200 used is, for example, the drain panel 10 described in U.S. Pat. No. 6,129,482 of the applicant or the connection chamber 10 described in U.S. Pat. No. 6,322,288 of the applicant, the contents of the two patents are incorporated herein by reference. As shown in FIG. 8, connection member 200 has a plurality of ribs r1, r2, r3, and r4. For a secured connection of the members, the respective side deck member 36*d* preferably includes an engaging lip 45 such as a groove portion therein configured to receive a rib r1 of connection member 200 or another reinforcing member (such as rib r1 or RE of U.S. Pat. No. 6,129,482, or rib 20 or 56 of U.S. Pat. No. 6,322,288) therein in a relatively tight manner. Other suitable connection conduits, chambers or conventional pipes are also conceivable as the means to be connected to the side deck members.

Figure 9:
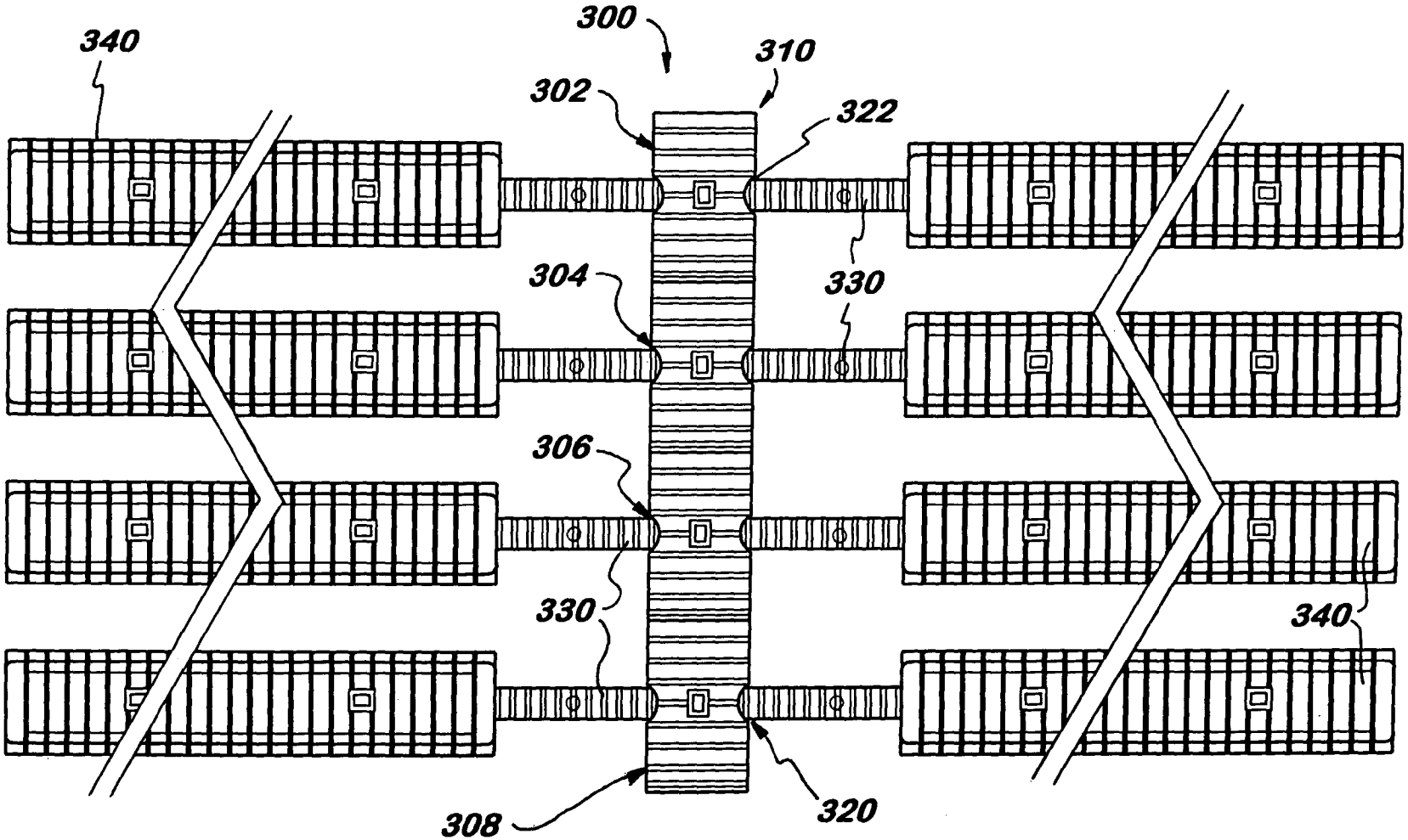
FIGS. 9–12 are top schematic views illustrating exemplary drainage systems incorporating the liquid dispensing chambers of the invention.

With particular references to FIGS. 9–12, exemplary drainage systems incorporating the chambers of the present invention are described herein. Referring to FIG. 9, drainage system 300 includes a header chamber assembly 310 with a plurality of header chambers of the "double-tee type" (such as chamber 90 of FIG. 7) connected by the lay-up connection method described herein-above with reference to FIG. 1. Four "double-tee type" header chambers 302, 304, 306 and 308 are used in this embodiment. However, other number of chambers may be used. It is also contemplated that header chamber assembly 310 may be a unitary extended chamber having multiple (e.g., four) side deck members 320 appropriately disposed in either side thereof. Here, two end header chambers 302 and 308 are the end-use type ("E-type") and two intermediate header chambers 304 and 306 are the intermediate-use type ("I-type"), as described above with respect to FIG. 1. A first end portion (such as 18 in FIG. 1) of chamber 302 includes an axial opening (such as 24 in FIG. 4 ) connected directly or indirectly to a liquid source, such as a catch basin. Each header chamber 302–308 includes a pair of side deck members 320 with respective lateral openings 322. Drainage system 300 further includes a plurality of connection chambers 330 mounted to the (double-tee) lateral openings 322 of the chamber assembly 310 which are configured and dimensioned to receive the end portion of the connection chambers 330 thereto (preferably by the lay-up connection method with the rib-and-groove engagement as described above). In the preferred embodiment, eight (8) connection chambers such as those described in above-mentioned U.S. Pat. Nos. 6,129,482 or 6,322,288 are utilized. Eight serially connected drainage chambers 340 such as those described in U.S. Pat. No. 5,087,151 of the applicant are assembled in a method similar to the lay-up connection method of the invention (see also FIGS. 12 and 13 of the U.S, Pat. No. 5,087,151). The eight serial drainage chambers 340 are now respectively connected to the eight connection chambers 330 with respective axial apertures of the serial drainage chambers (such as 46 in FIG. 1 of the '151 patent) connected to the respective end portion of the eight connection chambers 330 preferably by the above-mentioned lay-up connection method. In operation, the drainage system 300 of the invention receives the storm-water or liquid effluent initially through the inner volume of the header chamber assembly 310. It then flows to the eight connection chambers 330 through the side deck members 320, and finally to the eight serial drainage chambers 340. These eight serial drainage chambers 340 constitute a major drain or leaching field for the storm-water or any kinds of waste liquids.

Figure 10:
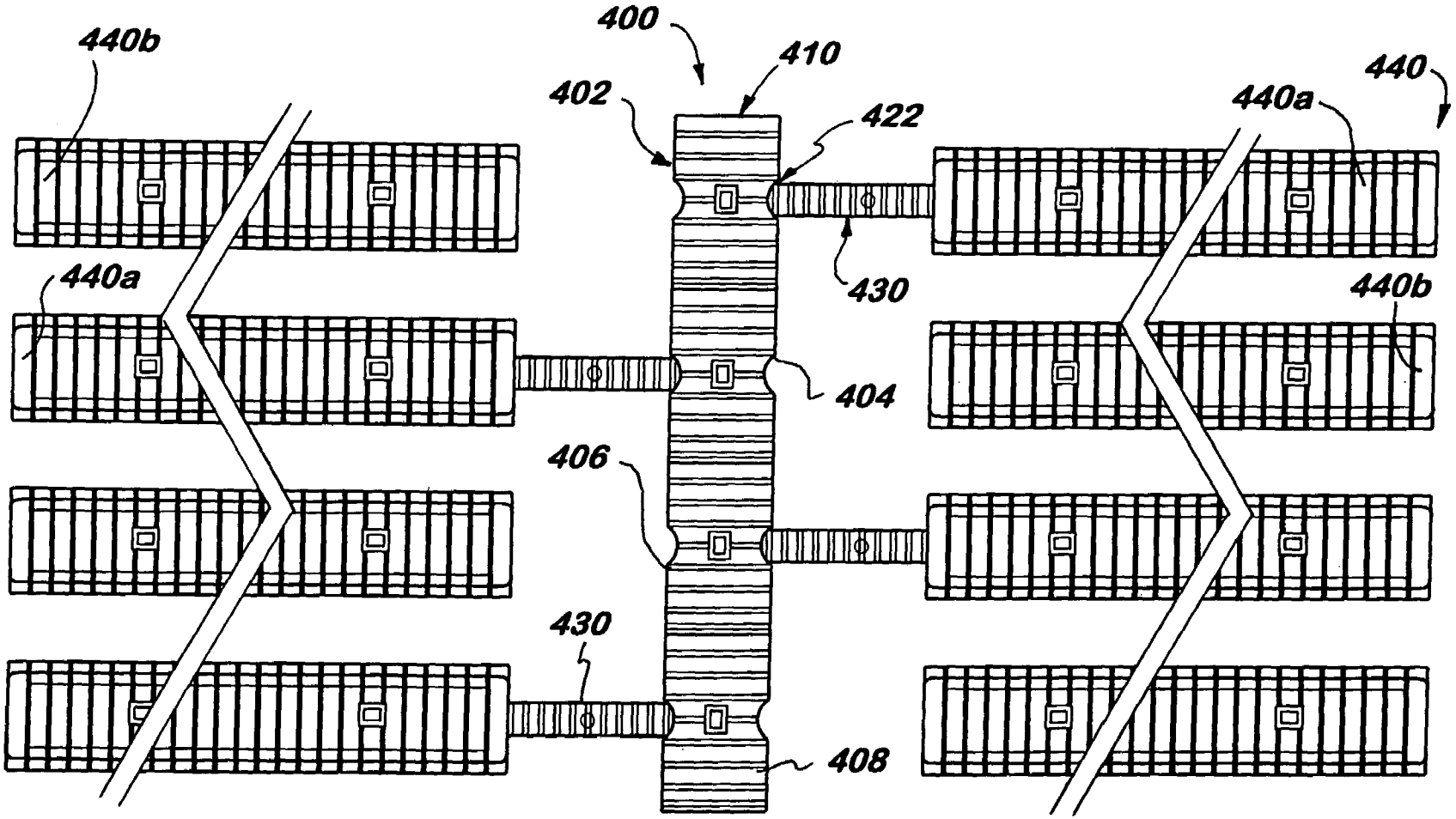

Referring to FIG. 10, another example of the drainage system incorporating the chambers of the invention is described herein. Drainage system 400 of the invention is similar to the drainage system 300 described herein-above except some features discussed herein. Drainage system 400 includes a header chamber assembly 410 with two "right-tee type" header chambers 402, 406 (such as chambers 70 of FIG. 3) and two "left-tee type" header chambers 404, 408 (such as chambers 80 of FIG. 6) connected alternately by the lay-up connection method described herein-above. Four header chambers 402, 404, 406 and 408 are used in this embodiment. However, other number of chambers may be used. It is also contemplated that header chamber assembly 410 may be a unitary extended chamber having multiple (e.g., two) side deck members 420 appropriately disposed in either side thereof. Here, two end header chambers 402 and 408 are the end-use type ("E-type") and two intermediate header chambers 404 and 406 are the intermediate-use type ("I-type"). A first end portion (such as 18 in FIG. 1) of header chamber 402 includes an axial opening (such as 24 in FIG. 1) connected directly or indirectly to a liquid source, such as a catch basin. Each chamber 302–308 includes at least one side deck member 420 with respective lateral openings 422 therein. Drainage system 400 further includes a plurality of connection chambers 430 mounted to the respective lateral openings 422 of the header chamber assembly 410 which are configured and dimensioned to receive the end portion of the connection chambers 430 thereto (preferably by the lay-up connection method with the rib-and-groove engagement as described above). In the preferred embodiment, four (4) connection chambers such as those described in above-mentioned U.S. Pat. Nos. 6,129,482 or 6,322,288 are utilized. Eight serially connected drainage chambers 440 such as those described in U.S. Pat. No. 5,087,151 of the applicant are assembled in a method similar to the lay-up connection method of the invention (see also FIGS. 12 and 13 of the U.S. Pat. No. 5,087,151). Four alternate serial drainage chambers 440*a* out of the eight serial drainage chambers 440 are now respectively connected to the four connection chambers 430 with respective axial apertures of the serial drainage chambers (such as 46 in FIG. 1 of the '151 patent) connected to the respective end portion of the four connection chambers 430 preferably by the above-mentioned lay-up connection method. The four serial drainage chambers 440*a* connected to the four connection chambers 430 and the remaining four serial drainage chambers 440*b* may or may not be laterally connected via suitable connection members. In operation, the drainage system 400 of the invention receives the storm-water or liquid effluent initially through the inner volume of the header chamber assembly 410. It then flows to the four connection chambers 430 through the side deck members 420, and finally to the four serial drainage chambers 440*a* connected thereto. The overflowing storm-water or liquid effluent may then transfer or emerge into the remaining four serial drainage chambers 440*b* (either through the lateral connections thereof or by flooding through the open bottoms and/or infiltration apertures of the elongated wall body) for further drainage there-through. These eight serial drainage chambers 440 constitute a major drain or leaching field for the storm-water or any kinds of waste liquids.

Figure 11:
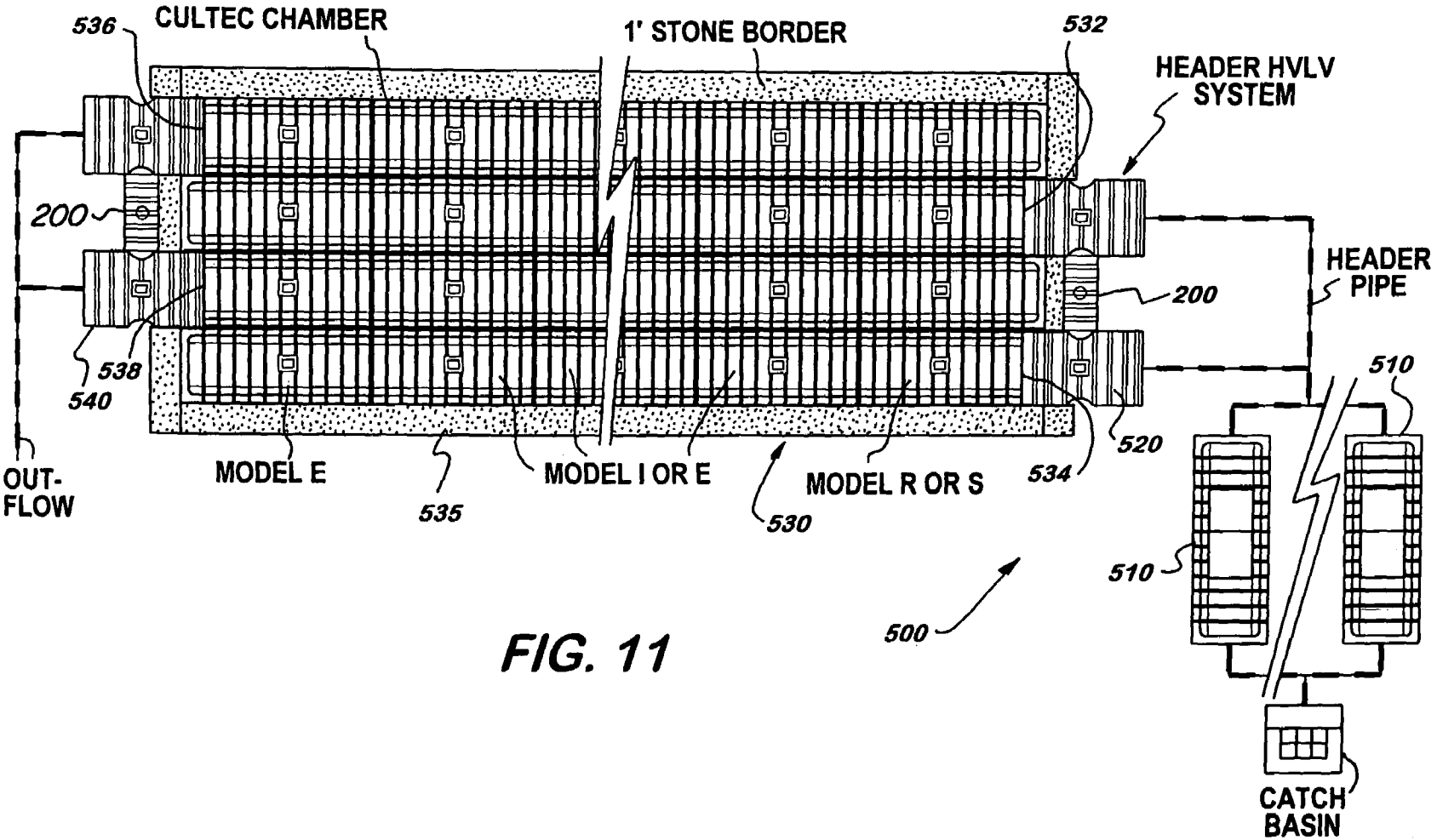

Referring to FIG. 11, a further example of the drainage system incorporating the chambers of the invention is described herein. Drainage system 500 includes at least one Stormfilter™ 510 connected via suitable conduits to a catch basin for receiving the storm-water therein and removing particles and debris from the water. Here, Stormfilter™ 510 is a product provided by Cultec, Inc., Brookfield, Connecticut. U.S. Pat. No. 5,419,838 of the applicant describes some features of the Stormfilter™ 510, the contents of which are incorporated herein by reference.

Drainage system 500 further includes two liquid dispensing header chambers 520, with a first end connected to the Stormfilter™ 510 and a second end serially connected to a field drain panel 530, which is preferably surrounded by gravel or stone 535 and functions as a main drain field. The two liquid dispensing header chambers 520 are preferably laterally connected to each other using a suitable connection chamber (such as 200 in FIG. 8 or 330 in FIG. 9). Field drain panel 530 utilized herein may be the type described in above-mentioned U.S. Pat. Nos. 6,129,482 of the applicant, having two end portions 532 and 534 adapted to be tightly connected to the second end of the respective liquid dispensing header chamber 520, preferably by the lay-up connection as described above. Drainage system 500 may further include additional two liquid dispensing chambers 540 connected serially to the opposing two end portions 536 and 538 of the field drain panel 530 as shown in the figure. These additional chambers 540 are to provide an outflow, if desired.

Figure 12:
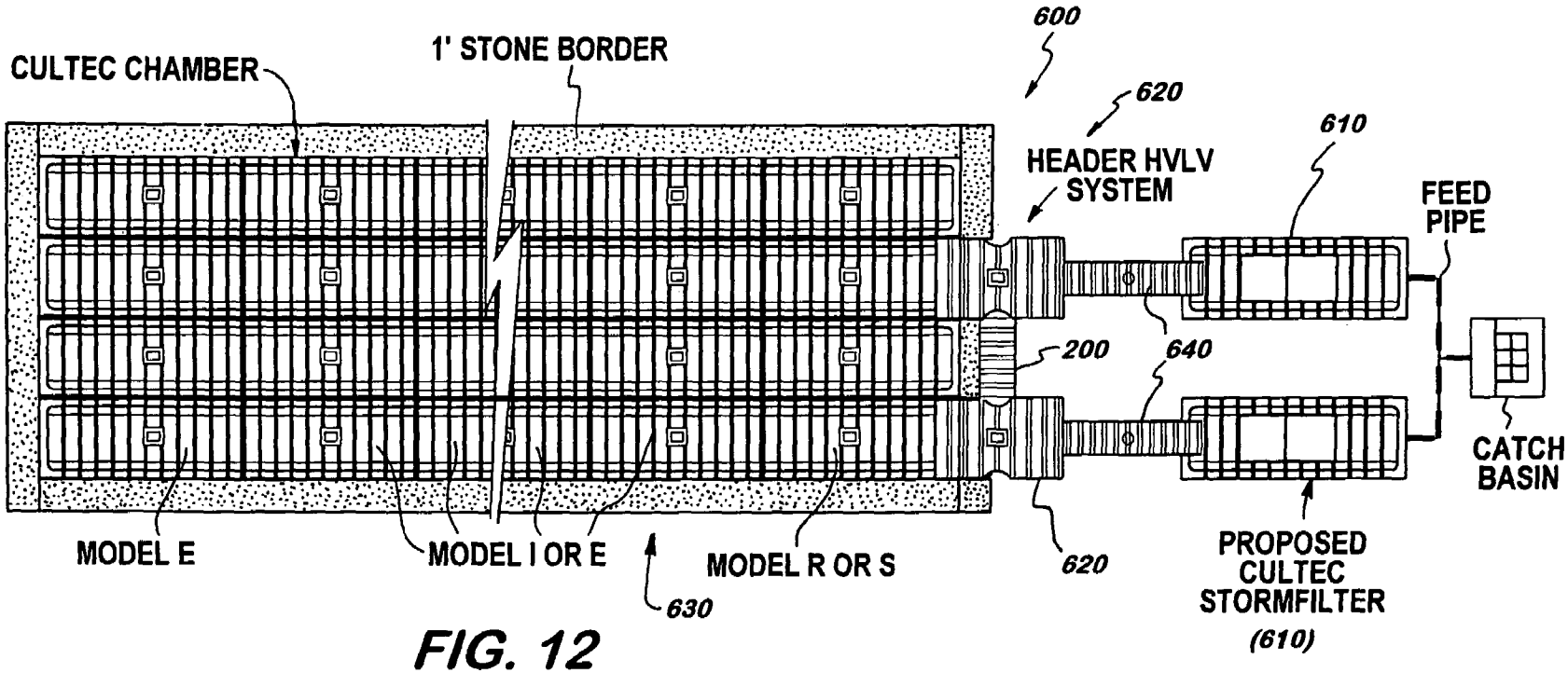

Referring to FIG. 12, a further example of the drainage system incorporating the chambers of the invention is described herein. Drainage system 600 is similar to the drainage system of FIG. 11 except that: (1) It does not include additional two dispensing chambers (such as 540 in FIG. 11) thus providing no outflow from the system, and (2) the interfaces between two Stormfilters™ 610 and two liquid dispensing header chambers 620 are replaced by connection chambers 640 instead of, for example, conventional pipes. Connection chambers 640 can be the type described in FIG. 8 (reference 200). Features not specifically described herein with FIG. 12 are the same as or similar to those described herein-above with regard to FIG. 11.

Although the invention has been described and illustrated with respect to the exemplary embodiments thereof, it should be understood by those skilled in the art that various other changes, omissions, and additions may be made therein and thereto, without parting from the spirit and scope of the present invention.

What is claimed is:

1. A liquid dispensing chamber for use with a drainage system for gathering and dispensing liquids to the ground, the liquid dispensing chamber comprising:

an elongated wall body having a generally arch-shaped cross-sectional configuration with a top wall portion and a pair of side wall portions thereby defining an enlarged enclosure therein, the elongated wall body including a first end portion and a second end portion;

a plurality of circumferential reinforcing members disposed along the circumference of the elongated wall body for reinforcing structural strength thereof;

at least one side deck member disposed at a bottom area of the side wall portions of the elongated wall body, the side deck member including a raised wall generally of arch shape extending outwards from the surface of the side wall portions, the raised wall configured to connect an external connection member by engagement of an engaging lip of a lateral opening in said side deck member with a rib on a connection member positioned within the lateral opening, the rib positioned within the engaging lip; and a plurality of infiltration apertures disposed along the elongated wall body.

2. The liquid dispensing chamber of claim 1, wherein the lateral opening in said side deck member is preformed in the at least one side deck member to allow lateral flow of liquids there-through.

3. The liquid dispensing chamber of claim 2, wherein the lateral opening of the at least one deck member is generally arch-shaped.

4. The liquid dispensing chamber of claim 1 wherein the at least one side deck member adjoins at least one of the circumferential reinforcing members.

5. The liquid dispensing chamber of claim 4, wherein the at least one side deck member adjoins three of the circumferential reinforcing members.

6. The liquid dispensing chamber of claim 1, wherein the first end portion of the elongated wall body is closed and the second end portion of the elongated wall body defines an axial opening therein to allow axial flow of liquids there-through.

7. The liquid dispensing chamber of claim 1, wherein the first end portion and the second end portion of the elongated wall body each define a respective opening therein to allow axial flow of liquids there-through.

8. The liquid dispensing chamber of claim 1 wherein the plurality of circumferential reinforcing members each have a rib-like configuration.

9. The liquid dispensing chamber of claim 8, wherein at least one of the plurality of circumferential reinforcing members has a rib smaller than the ribs of the remaining reinforcing members for facilitating stack-up connection of liquid dispensing chambers in end-to-end relationship with one another.

10. The liquid dispensing chamber of claim 1 further including a flange portion extending laterally from the side wall portions of the elongated wall body.

11. The liquid dispensing chamber of claim 1 further including an access panel at the top wall portion of the elongated wall body.

12. The liquid dispensing chamber of claim 1 wherein the chamber is made of plastic material.

13. A drainage system, comprising:

a first arch-shaped drainage chamber having an elongated body with arched side walls and two end walls, said arched wall having a plurality of circumferential reinforcing members disposed along a length of said chamber, an open bottom, and an arch shaped cutout in one end wall;

a second arch-shaped drainage chamber having an elongated body with arched side walls and two end walls, said arched wall having a plurality of circumferential reinforcing members disposed along a length of said chamber, and an open bottom, and an arch shaped cutout in one end wall;

one or more arch-shaped header chambers each having an elongated body with arched side walls having a plurality of circumferential reinforcing members disposed along a length of said chamber and an open bottom, and each having at least one side deck member disposed on a lower part of a side wall, said side deck member having an arch-shaped wall extending outwardly from said side wall and having an open bottom; said one or more header chambers together having a total of at least two said side deck members;

two of said side deck members having arch-shaped side deck openings therein for receiving an end of a connection member, said side deck openings each having an engaging lip;

first and second arch-shaped connection chambers, each having open first and second ends;

the first end of the first connection chamber being positioned within said arch-shaped cut out in one end wall of said first arch-shaped drainage chamber;

the second end of the first connection chamber having a rib, said first connection chamber rib being positioned within the side deck opening of one said side deck member with said first connection chamber rib engaged with said engaging lip of said side deck opening;

the first end of the second connection chamber being positioned within said arch-shaped cut out in one end wall of said second arch-shaped drainage chamber;

the second end of the second connection chamber having a rib, said second connection chamber rib being within the side deck opening of another said side deck member with said second connection chamber rib engaged with said engaging lip of said side deck opening.

14. A drainage system, comprising:

a first arch-shaped drainage chamber having an elongated body with arched side walls and two end walls, said arched wall having a plurality of circumferential reinforcing members disposed along a length of said chamber, an open bottom, and an arch shaped cutout in one end wall;

a first arch-shaped header chamber having an elongated body with arched side walls having a plurality of circumferential reinforcing members disposed along a length of said chamber and an open bottom, and at least one side deck member disposed on a lower part of a side wall, said side deck member having an arch-shaped wall extending outwardly from said side wall and having an open bottom and an arch-shaped side deck opening therein for receiving an end of a connection member, said side deck opening having an engaging lip, said first header chamber having one closed end and one open end in an overlapping connection with an open end of said first drainage chamber;

a second arch-shaped drainage chamber having an elongated body with arched side walls and two end walls, said arched wall having a plurality of circumferential reinforcing members disposed along a length of said chamber, and an open bottom, and an arch shaped cutout in one end wall;

a second arch-shaped header chamber having an elongated body with arched side walls having a plurality of circumferential reinforcing members disposed along a length of said chamber and an open bottom, and at least one side deck member disposed on a lower part of a side wall, said side deck member having an arch-shaped wall extending outwardly from said side wall and having an open bottom and an arch-shaped side deck opening therein for receiving an end of a connection member, said side deck opening having an engaging lip, said second header chamber having one closed end and one open end in an overlapping connection with an open end of said second drainage chamber;

an arch-shaped connection chamber having open first and second ends, the first end of the connection chamber having a rib, said first end rib being positioned within the side deck opening of said first header chamber with said first end rib engaged with said engaging lip of said side deck opening, and the second end of the connection chamber having a rib, said second end rib being positioned within the side deck opening of said second header chamber with said second end rib engaged with said engaging lip of said side deck opening.

* * * * *